US006272804B1

(12) United States Patent
Leis

(10) Patent No.: US 6,272,804 B1
(45) Date of Patent: Aug. 14, 2001

(54) RECESSED TRAY FLOOR DRAIN

(76) Inventor: Jamie J. Leis, 18571 Ibsen Rd., Sparta, WI (US) 54656

( * ) Notice: Subject to any disclaimer, the term of this patent is extended or adjusted under 35 U.S.C. 154(b) by 0 days.

(21) Appl. No.: 09/321,168

(22) Filed: May 27, 1999

(51) Int. Cl.[7] ..... E04B 1/70
(52) U.S. Cl. ..... 52/302.1; 210/164
(58) Field of Search ..... 52/302.1, 302.7; 210/163, 164, 165; 4/613, 652

(56) References Cited

U.S. PATENT DOCUMENTS 2,182,795 * 12/1939 Day ..... 210/164
5,032,264 * 7/1991 Geiger ..... 210/164
5,230,188 * 7/1993 Nurse ..... 210/164
5,529,431 * 6/1996 Walsh ..... 210/164
5,575,925 * 11/1996 Logue, Jr. ..... 210/164
5,733,445 * 3/1998 Fanelli ..... 210/164
5,864,990 * 2/1999 Tu ..... 210/164
6,021,792 * 2/2000 Petter et al. ..... 210/164
6,139,729 * 10/2000 Gonzalez, Jr. ..... 210/164

* cited by examiner

*Primary Examiner*—Michael Safavi

(57) ABSTRACT

A recessed tray floor drain for collecting ice cubes falling on to a floor surface so that people do not slip on the fallen ice cubes when traversing the floor surface. The recessed tray floor drain includes a tray with a bottom wall and a perimeter side wall. The perimeter side wall of the tray has an inner shoulder therearound. A grate substantially covers the open top of the tray and is rested on the inner shoulder of the perimeter side wall. The bottom wall of the tray has an drain hole.

12 Claims, 2 Drawing Sheets

RECESSED TRAY FLOOR DRAIN

BACKGROUND OF THE INVENTION

1. Field of the Invention

The present invention relates to floor drain systems and more particularly pertains to a new recessed tray floor drain for collecting ice cubes falling on to a floor surface so that people do not slip on the fallen ice cubes when traversing the floor surface.

2. Description of the Prior Art

The use of floor drain systems is known in the prior art. More specifically, floor drain systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,485,769 by Johannessen; U.S. Pat. No. 5,154,024 by Noel; U.S. Pat. No. 3,287,742 by Gaddis; U.S. Pat. No. Des. 280,925 by Farnen; U.S. Pat. No. 4,092,745 by Oropallo; and U.S. Pat. No. 4,594,739 by Watts.

While these devices fulfill their respective, particular objectives and requirements, the aforementioned patents do not disclose a new recessed tray floor drain. The inventive device includes a tray with a bottom wall and a perimeter side wall. The perimeter side wall of the tray has an inner shoulder therearound. A grate substantially covers the open top of the tray and is rested on the inner shoulder of the perimeter side wall. The bottom wall of the tray has an drain hole.

In these respects, the recessed tray floor drain according to the present invention substantially departs from the conventional concepts and designs of the prior art, and in so doing provides an apparatus primarily developed for the purpose of collecting ice cubes falling on to a floor surface so that people do not slip on the fallen ice cubes when traversing the floor surface.

SUMMARY OF THE INVENTION

In view of the foregoing disadvantages inherent in the known types of floor drain systems now present in the prior art, the present invention provides a new recessed tray floor drain construction wherein the same can be utilized for collecting ice cubes falling on to a floor surface so that people do not slip on the fallen ice cubes when traversing the floor surface.

The general purpose of the present invention, which will be described subsequently in greater detail, is to provide a new recessed tray floor drain apparatus and method which has many of the advantages of the floor drain systems mentioned heretofore and many novel features that result in a new recessed tray floor drain which is not anticipated, rendered obvious, suggested, or even implied by any of the prior art floor drain systems, either alone or in any combination thereof.

To attain this, the present invention generally comprises a tray with a bottom wall and a perimeter side wall. The perimeter side wall of the tray has an inner shoulder therearound. A grate substantially covers the open top of the tray and is rested on the inner shoulder of the perimeter side wall. The bottom wall of the tray has an drain hole.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new recessed tray floor drain apparatus and method which has many of the advantages of the floor drain systems mentioned heretofore and many novel features that result in a new recessed tray floor drain which is not anticipated, rendered obvious, suggested, or even implied by any of the prior art floor drain systems, either alone or in any combination thereof.

It is another object of the present invention to provide a new recessed tray floor drain which may be easily and efficiently manufactured and marketed.

It is a further object of the present invention to provide a new recessed tray floor drain which is of a durable and reliable construction.

An even further object of the present invention is to provide a new recessed tray floor drain which is susceptible of a low cost of manufacture with regard to both materials and labor, and which accordingly is then susceptible of low prices of sale to the consuming public, thereby making such recessed tray floor drain economically available to the buying public.

Still yet another object of the present invention is to provide a new recessed tray floor drain which provides in the apparatuses and methods of the prior art some of the advantages thereof, while simultaneously overcoming some of the disadvantages normally associated therewith.

Still another object of the present invention is to provide a new recessed tray floor drain for collecting ice cubes falling on to a floor surface so that people do not slip on the fallen ice cubes when traversing the floor surface.

Yet another object of the present invention is to provide a new recessed tray floor drain which includes a tray with a bottom wall and a perimeter side wall. The perimeter side wall of the tray has an inner shoulder therearound. A grate substantially covers the open top of the tray and is rested on the inner shoulder of the perimeter side wall. The bottom wall of the tray has an drain hole.

Still yet another object of the present invention is to provide a new recessed tray floor drain that provides additional safety against slipping on ice cubes that have fallen or spilled out of an ice making machine or an ice dispensing machine.

Even still another object of the present invention is to provide a new recessed tray floor drain that has a removable top grate so that the tray may be regularly cleaned.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
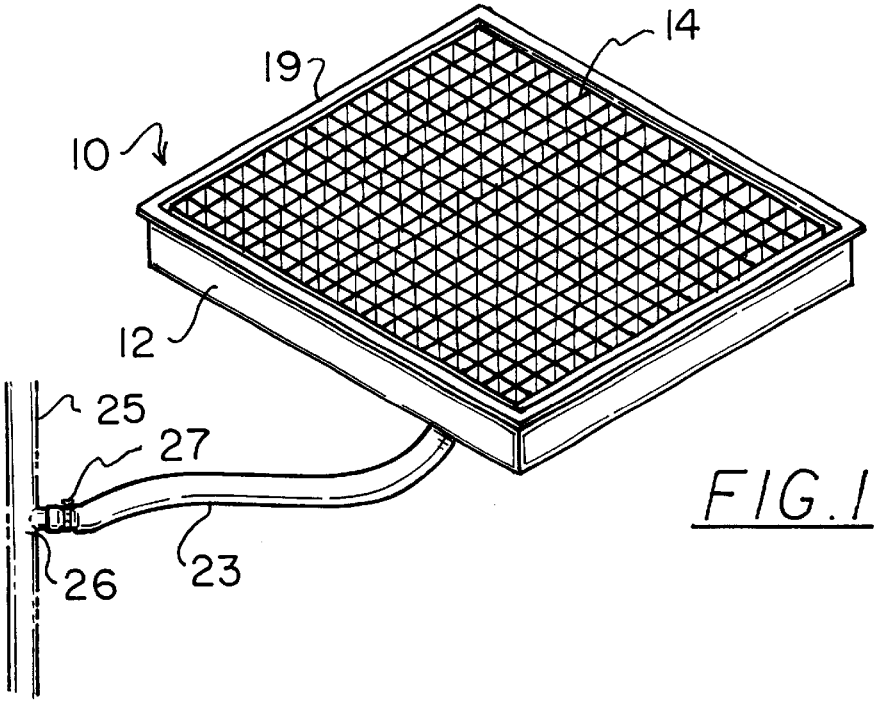
FIG. 1 is a schematic perspective view of a new recessed tray floor drain according to the present invention.
Figure 2:
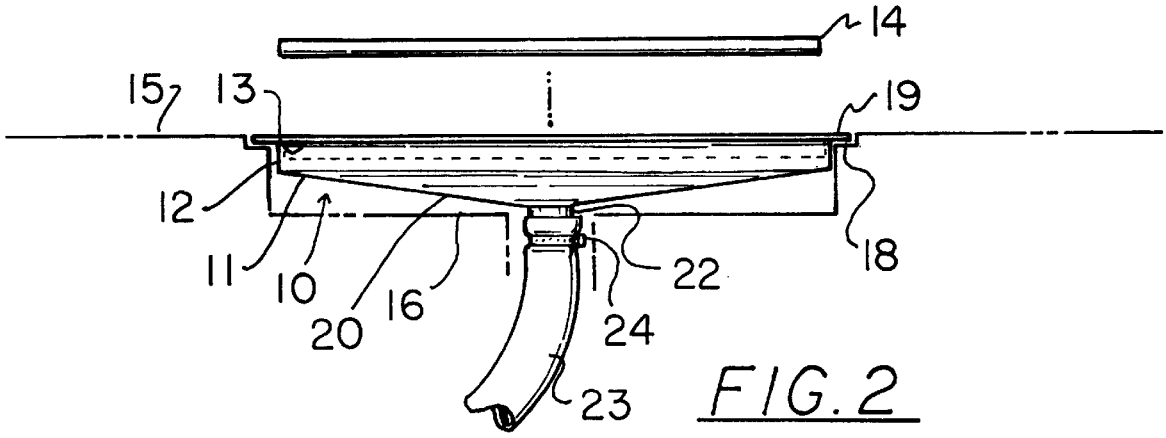
FIG. 2 is a schematic side view of the present invention in a floor surface.
Figure 3:
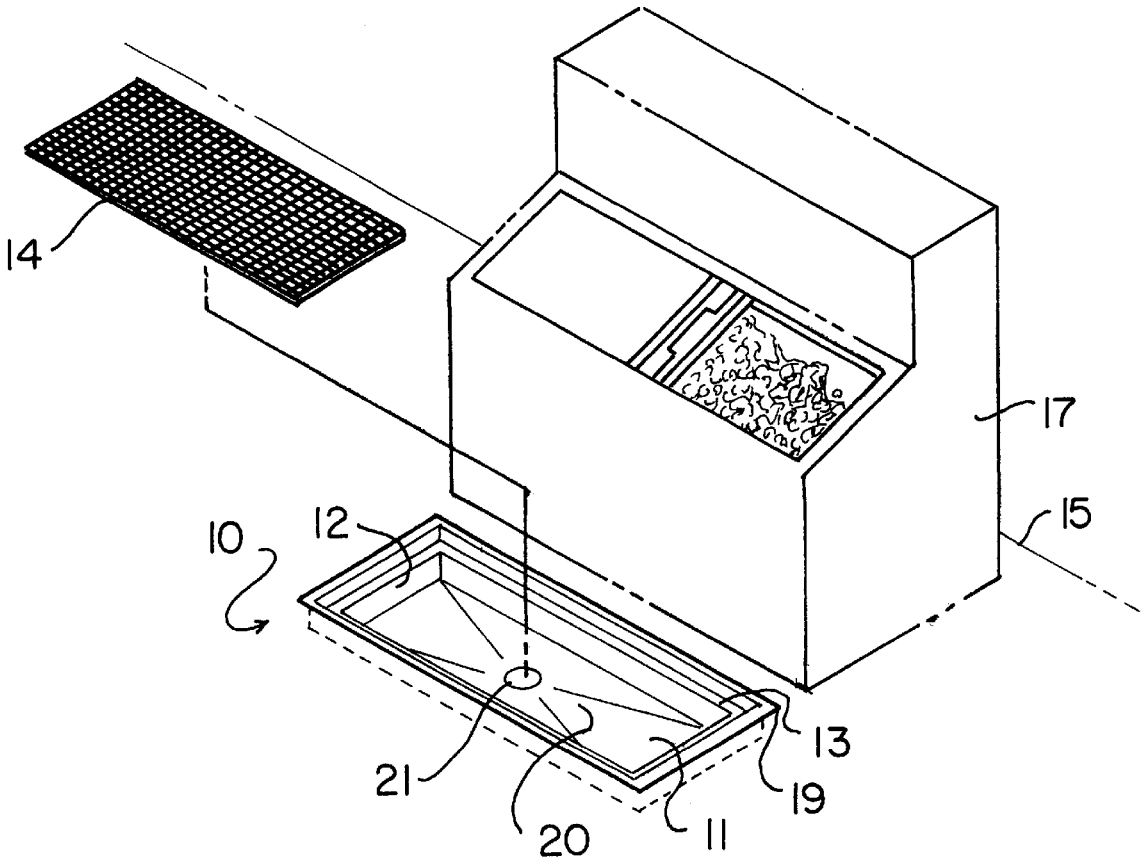
FIG. 3 is a schematic perspective view of the present invention in use next to an ice dispenser/maker.

With reference now to the drawings, and in particular to FIGS. 1 through 3 thereof, a new recessed tray floor drain embodying the principles and concepts of the present invention will be described.

As best illustrated in FIGS. 1 through 3, the recessed tray floor drain generally comprises a tray with a bottom wall and a perimeter side wall. The perimeter side wall of the tray has an inner shoulder therearound. A grate substantially covers the open top of the tray and is rested on the inner shoulder of the perimeter side wall. The bottom wall of the tray has an drain hole.

In use, the recessed tray floor drain is designed for collecting falling ice cubes from an ice cube dispenser (which, for purposes of this invention, also includes ice cube making machines and the like found in restaurants and convenience stores). In closer detail, the recessed tray floor drain comprises a tray 10 with a bottom wall 11 and a perimeter side wall 12 upwardly extending around the bottom wall of the tray. Together, the bottom wall and the perimeter side wall of the tray define a reservoir has an open top for holding ice cubes therein. Preferably, the bottom wall of the tray has a generally rectangular outer perimeter. The perimeter side wall of the tray has an open generally rectangular configuration with an upper edge, and an inner shoulder 13 therearound adjacent the upper edge of the perimeter side wall.

A generally rectangular grate 14 substantially covers the open top of the tray. The grate has a plurality of apertures of a predetermined size therethrough for permitting the passage of an ice cube therethrough but permitting a person to walk on the grate without a foot of the person falling through one of the apertures. The grate is rested on the inner shoulder of the perimeter side wall such that the grate is spaced above the bottom wall of the tray. This allows the grate to be removable from over the tray to permit access to the tray from the floor surface so that the tray may be cleaned and any debris in the tray removed. Ideally, the tray and grate comprises aluminum or stainless steel.

In use, the tray is designed for a floor surface 15 having a generally rectangular recess 16 therein. Preferably, the recess is positioned adjacent an ice cube dispenser 17 above the floor surface and which may also be resting on the floor surface adjacent the recess as illustrated in FIG. 3. The recess in the floor surface has a generally rectangular upper shoulder 18 therealong adjacent the floor surface.

As best illustrated in FIG. 2, the tray is disposed in the recess in the floor surface such that the open top of the tray faces in an upwards direction from the floor surface. The perimeter side wall of the tray has an outwardly extending upper lip 19 along the upper edge of the perimeter side wall. The upper lip of the perimeter side wall is rested on the upper shoulder of the recess in the floor surface such that the grate and the floor surface are generally coplanar with one another so that the grate in effect becomes part of the floor surface. In use, the positioning of the recess and tray allows ice cubes falling from the ice cube dispenser to fall through the grate and into the reservoir of the tray where they are collected and left to melt.

The bottom wall of the tray has a generally rectangular outer perimeter and an inverted generally fusto-pyramidal depression 20 downwardly converging towards a central region of the bottom wall. The bottom wall of the tray has an drain hole 21 at the central region of the bottom wall. Preferably, the bottom wall of the tray has a generally cylindrical connecting pipe 22 downwardly depending therefrom around the drain hole of the bottom wall.

A tubular flexible conduit 23 is provided having a pair of open ends. The connecting pipe of the tray is inserted into one of the ends of the conduit to fluidly connect the one end of the conduit to the drain hole of the tray to permit water from the melting ice in the tray to flow out of the tray into the conduit. As best illustrated in FIG. 2, a fastening collar 24 is disposed around the one end of the conduit and the connecting pipe to couple the one end of the conduit to the connecting pipe.

A drain pipe 25 fluidly connected to a sewer system is provided in the structure container the floor surface. The other of the ends of the conduit is fluidly connected to a connecting pipe 26 of the drain pipe with another fastening collar 27 disposed therearound to couple the other end of the conduit to the connecting pipe of the drain pipe to permit water from the melted ice to pass into the drain pipe.

Ideally, the perimeter side wall has a height defined between the bottom wall and the upper edge of the tray of about 1 inch. In this ideal embodiment, the depression of the bottom wall has a depth defined downwardly from the perimeter side wall to the central region of the bottom wall also of about 1 inch. This provides an optimal slope for permitting water from the melting ice to easily flow into the drain hole. Additionally, with added to the height of the perimeter side wall, the overall depth of the tray is kept to around about 2 inches so that it may easily be installed in existing floor structures without fear of has to provide a recess with a depth greater than the thickness of the floor structure.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A system, comprising:

a tray having a bottom wall and a perimeter side wall upwardly extending around said bottom wall of said tray, said bottom wall and said perimeter side wall of said tray defining a reservoir having an open top;

said perimeter side wall of said tray having an inner shoulder therearound;

a grate having a plurality of apertures therethrough;

said grate substantially covering said open top of said tray, said grate being rested on said inner shoulder of said perimeter in side wall;

said grate having a first set of cross members positioned in a first orientation, said grate having a second set of cross members positioned in a second orientation, said first set of cross members being substantially perpendicular to said second set of cross members such that said first set of cross members and said second set of cross members form a grid, said grid being adapted for preventing a user from tripping on said grate; and said bottom wall of said tray having an drain hole;

a tubular flexible conduit having a pair of open ends, one of said ends of said conduit being fluidly connected to said drain hole of said bottom wall of said tray;

wherein said bottom wall of said tray has a connecting pipe downwardly depending therefrom around said drain hole of said bottom wall, wherein said connecting pipe of said tray is inserted into said one of said ends of said conduit to fluidly connect said one end of said conduit to said drain hole of said tray;

wherein a fastening collar is disposed around said one end of said conduit and said connecting pipe to couple said one end of said conduit to said connecting pipe;

a drain pipe, the other of said ends of said conduit being fluidly connected to said drain pipe;

wherein said other end of said conduit has a fastening collar disposed therearound to couple said other end of said conduit to connector of said drain pipe for permitting water from the melted ice to pass into said drain pipe.

2. The system of claim 1, further comprising a floor surface having a recess therein, wherein said tray is disposed in said recess in said floor surface such that said open top of said tray faces in an upwards direction from said floor surface.

3. The system of claim 2, wherein said recess in said floor surface has upper shoulder therealong adjacent said floor surface, wherein said perimeter side wall of said tray has an outwardly extending upper lip therearound, and wherein said upper lip of said perimeter side wall is rested on said upper shoulder of said recess in said floor surface.

4. The system of claim 1, wherein said bottom wall of said tray has depression downwardly converging towards a central region of said bottom wall, said drain hole being located at said central region of said bottom wall.

5. The system of claim 1 wherein the plurality of apertures each have a predetermined size permitting the passage of an ice cube therethrough.

6. The system of claim 1 wherein said grate is removable mounted over said tray to permit access to said tray from the floor surface such that said tray such that said tray must be cleaned.

7. A system comprising:

a tray having a bottom wall and a perimeter side wall upwardly extending around said bottom wall of said tray, said bottom wall and said perimeter side wall of said tray defining a reservoir having an open top;

said perimeter side wall of said tray having an inner shoulder therearound;

a grate having a plurality of apertures therethrough;

said grate substantially covering said open top to said tray, said grate being rested on said inner shoulder of said perimeter side wall;

said grate having a first set of cross members positioned in a first orientation, said grate having a second set of cross members positioned in a second orientation, said first set of cross members being substantially perpendicular to said second set of cross members such that said first set of cross members and said second set of cross members for a grid, said grid being adapted for preventing a user from tripping on said grate; and said bottom wall of said tray having an drain hole;

a floor surface having a recess therein, wherein said tray is disposed in said recess in said floor surface such that said open top of said tray faces in an upwards direction from said floor surface;

wherein said recess in said floor has an upper shoulder therealong adjacent said floor surface, wherein said perimeter side wall of said tray has an outwardly extending upper lip therearound, and wherein said upper lip of said perimeter side wall is rested on said upper shoulder of said recess in said floor surface;

wherein said perimeter side wall has a height defined between said bottom wall and said upper edge of said tray of about 1 inch.

8. A system, comprising:

a tray having a bottom wall and a perimeter side wall upwardly extending around said bottom wall of said tray, said bottom wall and said perimeter side wall of said tray defining a reservoir having an open top;

said perimeter side wall of said tray having an inner shoulder therearound;

a grate having a plurality of apertures therethrough;

said grate substantially covering said open top of said tray, said grate being rested on said inner shoulder of said perimeter side wall;

said grate having a first set of cross members positioned in a first orientation, said grate having a second set of cross members positioned in a second orientation, said first set of cross members being substantially perpendicular to said second set of cross members such that said first set of cross members and said second set of cross members from a grid, said grid being adapted for preventing a user from tripping on said grate;

said bottom wall of said tray having an drain hole;

wherein said bottom wall of said tray has depression downwardly converging towards a central region of said bottom wall, said drain hole being located at said central region of said bottom wall; and wherein said depression of said bottom wall having a depth defined downwardly from said perimeter side wall to said central region of said bottom wall of about 1 inch.

9. The system of claim 8, further comprising a tubular flexible conduit having a pair of open ends, one of said ends of said conduit being fluidly connected to said drain hole of said bottom wall of said tray.

10. The system of claim 9, wherein said bottom wall of said tray has a connecting pipe downwardly depending therefrom around said drain hole of said bottom wall, wherein said connecting pipe of said tray is inserted into said one of said ends of said conduit to fluidly connected said one end of said conduit to said drain hole of said tray.

11. The system of claim 10, wherein a fastening collar is disposed around said one end of said conduit and said connecting pipe to couple said one end of said conduit to said connecting pipe.

12. The system of claim 11, further comprising a drain pipe, the other of said ends of said conduit being fluidly connected to said drain pipe.

* * * * *